United States Patent [19]

Schrock et al.

[11] 4,087,911

[45] May 9, 1978

[54] FINGER HOLE KNIFE

[76] Inventors: Maurice D. Schrock, c/o George Spector, 3615 Woolworth Bldg., 233 Broadway; George Spector, 3615 Woolworth Bldg., 233 Broadway, both of New York, N.Y. 10007

[21] Appl. No.: 633,850

[22] Filed: Nov. 20, 1975

[51] Int. Cl.[2] ..... B26B 29/00

[52] U.S. Cl. ..... 30/286; 30/153; 30/298; 30/340

[58] Field of Search ..... 30/153, 291, 298, 340, 30/289, 288, 286

[56] References Cited

U.S. PATENT DOCUMENTS

| | | | |
|---|---|---|---|
| 449,031 | 3/1891 | Bernard | 30/340 X |
| 3,839,788 | 10/1974 | Addis | 30/287 |

*Primary Examiner*—Al Lawrence Smith
*Assistant Examiner*—J. T. Zatarga

[57] ABSTRACT

An improved design of knife in which there is a knife blade and a handle for being held in a user's hand, the handle having a hole extending therethrough so that a finger of the user can be inserted therein so to provide a more firm grip and prevent slipping of the knife in the hand; the knife design being readily adaptable for any knife such as either a pocket knife, boot knife, hunting knife or the like.

2 Claims, 10 Drawing Figures

10
1
2
3

20
1
2
3

30
1
2
3

80
81
83
88
86
10

81
82
85
89
87
84

40
1
2
3

50
1
2
3

60
1
3

70
1
2
3

FINGER HOLE KNIFE

This invention relates generally to knives of various types.

It is generally well known that the handling of a knife in the hand can be dangerous to the user in case his grip of the knife handle is loosened so that if the knife has no guard, there is always the risk of the hand sliding upon the blade and becoming cut. This situation is serious and is therefore in want of an improvement.

Accordingly, it is a principal object of the present invention to provide a knife that is designed having a hold transversely through its handle so that a person holding the knife handle, during use, can insert a finger through the hole at a same time thus giving a more firm grip thereof because the handle thus cannot slide in the hand grip.

Another object is to provide a finger hole knife wherein the finger hole design is readily applicable to any hand held knife, whether large such as a hunting knife or small such as a pocket knife or boot knife.

Another object is to provide a finger hole knife in which the finger hole replaces the need of a guard being built on the knife, thus cutting manufacturing costs.

Still another object is to provide a finger hole knife which accordingly uses less material in its production and thus is lighter in weight so that it is ideal for being carried upon a person, such as hunter, fisherman, camper or the like.

Other objects are to provide a finger hole knife which is simple in design, inexpensive to manufacture, rugged in construction, easy to use and efficient in operation.

These and other objects will be readily evident upon a study of the specification and the accompanying drawing wherein.

Figures 1, 2, 3, 4, 5, 6, 7, 8, 9, 10:
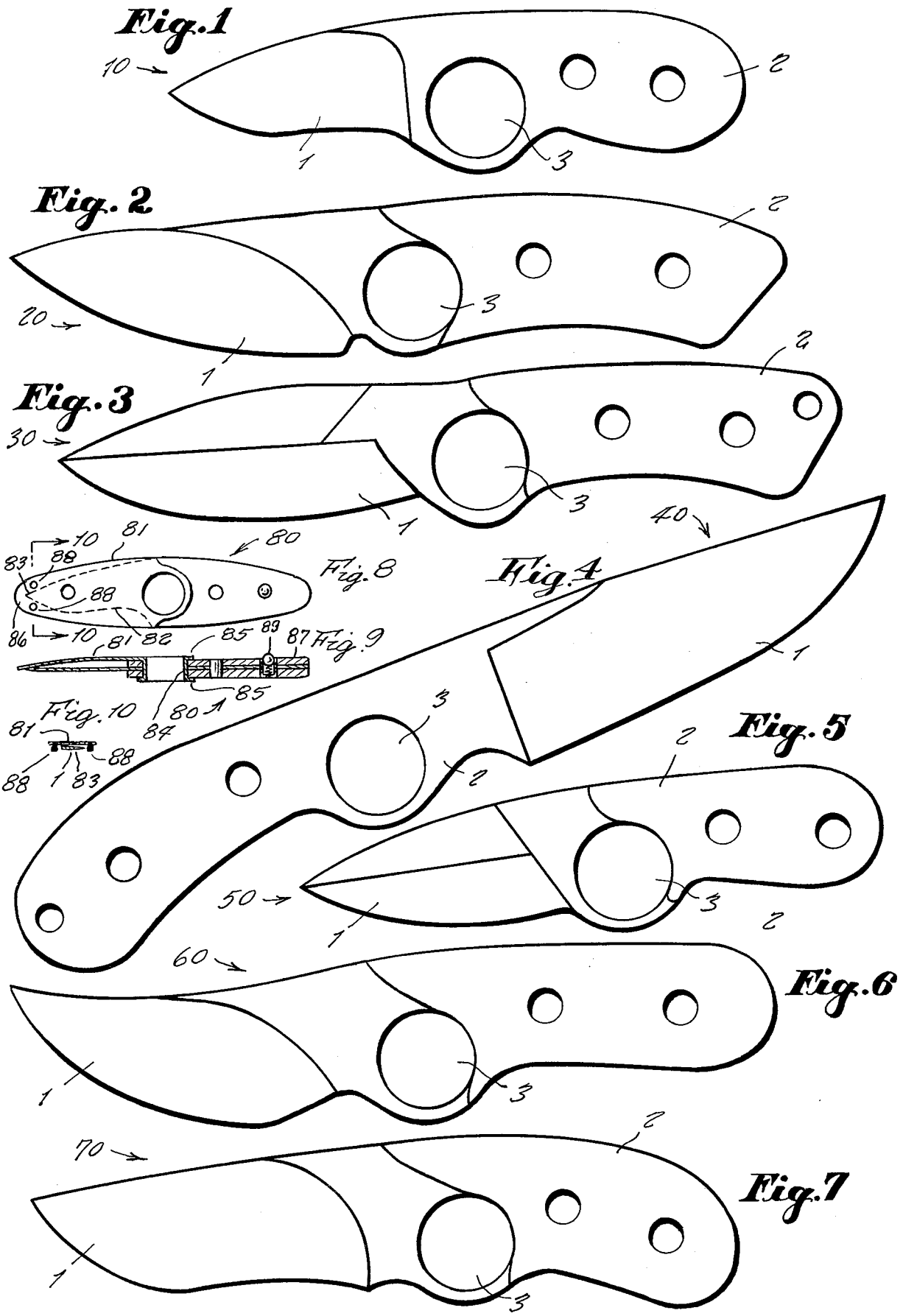
FIGS. 1 through 7 show different designs of knives shown incorporating the present invention.
FIG. 8 is a top view of a further modification providing a movable guard for the knife blade.
FIG. 9 is a longitudinal cross-section view through the center axis of the knife of FIG. 8.
FIG. 10 is a transverse cross-section through 10—10 of FIG. 8.

Refering now to the drawing in greater detail, each of the FIGS. 1 through 8 shows a different type of knife and wherein each includes a blade 1 at one end of a handle 2, and the handle having a transverse finger opening 3 therethrough so that a finger can be inserted therethrough so that a finger can be inserted therethrough while the handle is being held in the hand.

In FIG. 1, a backpacker's knife 10 is shown for being carried in a pocket and is stronger and more versatile than a conventional pocket knife. The blade length is 2¼ inches and the handle length is 2½ inches.

In FIG. 2 an all purpose small game knife 20 is used for small game and has the advantages of compactness in addition to lightness and positive gripping. The blade is 3 inches long and the handle is 3½ inches long.

In FIG. 3 the standard boot model knife 30 would be virtually impossible to be taken away from a user due to the positive gripping feature thereof. The blade measures 3¼ inches and the handle measures 3½ inches.

In FIG. 4, the all purpose hunting model knife 40 serves as a full size hunting knife while yet being compact, and is ideal for working on a carcass when hands and knife become slippery so that knife would easily slip in the hand were it not for the finger hole. The blade is 4 inches, and handle is 3½ inches long.

In FIG. 5, the law enforcement knife 50 is ideal for policemen. It can be fitted in a sheath and carried either in a boot or pocket. It is excellent for cutting, ripping or in self defense. The blade is 2½ inches and the handle is 2½ inches long.

In FIG. 6, the skinning knife 60 can be comfortably worn either on a belt or in a shoe. The blade is 3 inches and the handle is 3¼ inches long.

In FIG. 7, the small game and fish knife 70 can be worn likewise either on a belt or in a shoe, and is ideal for use on fish or game even such as a deer. The blade is 3 inches and the handle is 2½ inches long.

In FIGS. 8, 9 and 10 a knife 80 additionally includes a leaf spring 81 that serves as a guard for the blade cutting edge 82 and the point 83 thereof. The leaf spring is pivotable about one end by incorporating a sleeve 84 integral therewith and which rotatably slides inside the finger hole. A flange 85 is formed at each end of the sleeve so to retain it from removal out of the hole. The leaf spring has a normal slight bending curve so that the end 86 thereof bears against the blade tip. When pivoted one half way around, the end 86 bears against a side 87 of the handle. In order that the leaf spring can be retained in blade protecting position, as shown, two protrusions 88 on the end 86 thereof hold the blade tip therebetween. When the leaf spring is pivoted against the handle, a detent 89 of the handle fits between the protrusions so to keep the same in this position.

Thus different designs of the invention are provided.

While various changes may be made in the detail construction it is understood that such changes will be within the spirit and scope of the present invention as is defined by the appended claims.

What is claimed is:

1. A finger hole knife, comprising a knife blade and a handle having a transverse finger hole formed through a forward portion of said handle, said blade having a cutting edge extending rearwardly from a front tip to a wider rear section of the blade which extends from the said forward portion of the handle, said finger hole being spaced from the said rear section of the blade, said forward portion of the handle including an outer edge encompassing a portion of the said hole and extending outwardly beyond the said cutting edge of the blade to provide a better grip and protective protrusion, protecting the fingers of the user from the said cutting edge, a leaf spring guard comprising an elongated leaf spring integral at one end with a sleeve rotatably fitted in said hole, having radially outward flanges at each end of said sleeve, said leaf spring being longitudinally curved whereby a forward end bears against said blade tip, said leaf spring guard being pivotal to longitudinally extend forwardly superposed over the said blade in a closed position and to longitudinally extend rearwardly superposed over the said handle in an open position exposing the blade, and including means for retaining the guard in either of said positions.

2. A finger hole knife as recited in claim 1 wherein said means for retaining the guard in either of said positions comprises said forward end of said spring having spaced apart protrusions to receive said blade therebetween, and said handle having a detent receivable between said protrusions.

* * * * *